United States Patent [19]

Martin

[11] 4,134,286

[45] Jan. 16, 1979

[54] METHOD AND APPARATUS FOR EXPANDING TUBES

[75] Inventor: Paul W. Martin, Springfield, Ohio

[73] Assignee: Dresser Industries, Inc., Dallas, Tex.

[21] Appl. No.: 832,855

[22] Filed: Sep. 13, 1977

[51] Int. Cl.[2] ..... B21D 39/10

[52] U.S. Cl. ..... 72/122; 72/125; 29/157.4

[58] Field of Search ..... 29/157.4, 157.5; 72/118, 119, 120, 122, 123, 125

[56] References Cited

U.S. PATENT DOCUMENTS

| | | | |
|---|---|---|---|
| 2,355,852 | 8/1944 | Fisher | 29/157.4 |
| 3,449,812 | 6/1969 | Hauschke et al. | 29/157.4 |

FOREIGN PATENT DOCUMENTS

| | | | |
|---|---|---|---|
| 2517493 | 2/1977 | Fed. Rep. of Germany | 29/157.5 |

*Primary Examiner*—Lowell A. Larson

*Attorney, Agent, or Firm*—Roy L. Van Winkle; John N. Hazelwood

[57] ABSTRACT

A method of expanding a tube into engagement with a header wherein the expander is permitted to move longitudinally a predetermined amount relative to the tube while the expander is being rotated and expanding the tube into engagement with the header. The tube expanding apparatus includes a rotatable expander for insertion into the tube to be expanded, a stop collar that engages the header, a thrust collar that is fixed relative to the expander and a spring disposed between the stop collar and thrust collar permitting the thrust collar and expander to move relatively into the tube as the expander is rotated.

9 Claims, 5 Drawing Figures

METHOD AND APPARATUS FOR EXPANDING TUBES

BACKGROUND OF THE INVENTION

This invention relates generally to apparatus for expanding tubes into the plates or headers of heat exchangers or the like. More particularly, but not by way of limitation, this invention relates to an improved expander wherein the expander is permitted to move longitudinally with respect to the tube during the expanding operation.

In the manufacture of tube-type heat exchangers, it has been standard practice to roll or expand the tubing which extends through the heat exchanger header into tight sealing engagement therewith. Most tube expanders have the expanding rollers skewed slightly relative to the longitudinal axis of the tubing and expander so that they tend to feed or pull themselves into the tube as the expander is being rotated. One such expander is illustrated in U.S. Pat. No. 3,854,314 issued Dec. 17, 1974, to Paul Warren Martin.

Normally such expanders are prevented from moving longitudinally with respect to the tube, except in incremental steps as provided by the feeding devices used when rolling tubes in thick headers. Drift rolling, that is permitting the expander to move longitudinally during rolling, has been attempted manually. This manual procedure has not been successful because an operator cannot hold the expander to a constant preselected rolling interval. As a result, the expander rollers are not in engagement with the same quantity of tube material to be expanded or displaced and the interior of the tube, after rolling, is stepped rather than smooth as desired.

While such expanders have operated satisfactorily, they do tend to extrude the metal of the tube as it is being expanded toward the front of the header or tube sheet as well as toward the rear of the tube sheet since the thickness of the tube is changed by the rollling or expanding operation. In some applications, it is desirable to weld or otherwise affix the ends of the tubes to the tube sheet prior to the expanding operation. In this case, extreme forces are generated in the tubes while the tubes are being expanded.

An object of this invention is to provide an improved tube expander that avoids pulling the tube material toward the face of the header and thus eliminates the forces generated as a result of the extrusion of the tube material.

Another object of the invention is to provide an improved tubing expander wherein relative axial movement can occur between the expander and the tube during the rolling operation to avoid the imposition of axial forces toward the face of the header during the rolling operation and to provide a more uniform deformation.

SUMMARY OF THE INVENTION

In one aspect, this invention provides improved tubing expander apparatus comprising: an elongate, rotatable expander, that is inserted into the end of a tube to be expanded against the header; a stop collar encircling a portion of the expander, the stop collar having a first end for engaging the header and having a second end; and a thrust collar encircling a portion of the expander and the second end of the stop collar with the stop collar and thrust collar being axially and rotatably movable relative to each other. The thrust collar includes cooperable limit means to determine the relative axial movement between the thrust collar and stop collar. The thrust collar and expander are connected whereby the thrust collar and expander move together axially relative to the stop collar until the thrust collar engages the second end of the stop collar.

In another aspect, the invention contemplates an improved method for expanding a tube into engagement with a header that comprises the steps of: placing an expander having radially displaceable rollers thereon into the tubing at a preselected depth; rotating the expander and displacing the rollers radially outwardly to deform a specified portion of the tube into engagement with the header; and simultaneously permitting the expander to advance into the tube a preselected distance.

The foregoing and additional objects and advantages will become more apparent as the following detailed description is read in conjunction with the accompanying drawing.

DETAILED DESCRIPTION OF THE PREFERRED EMBODIMENT

Figure 1:
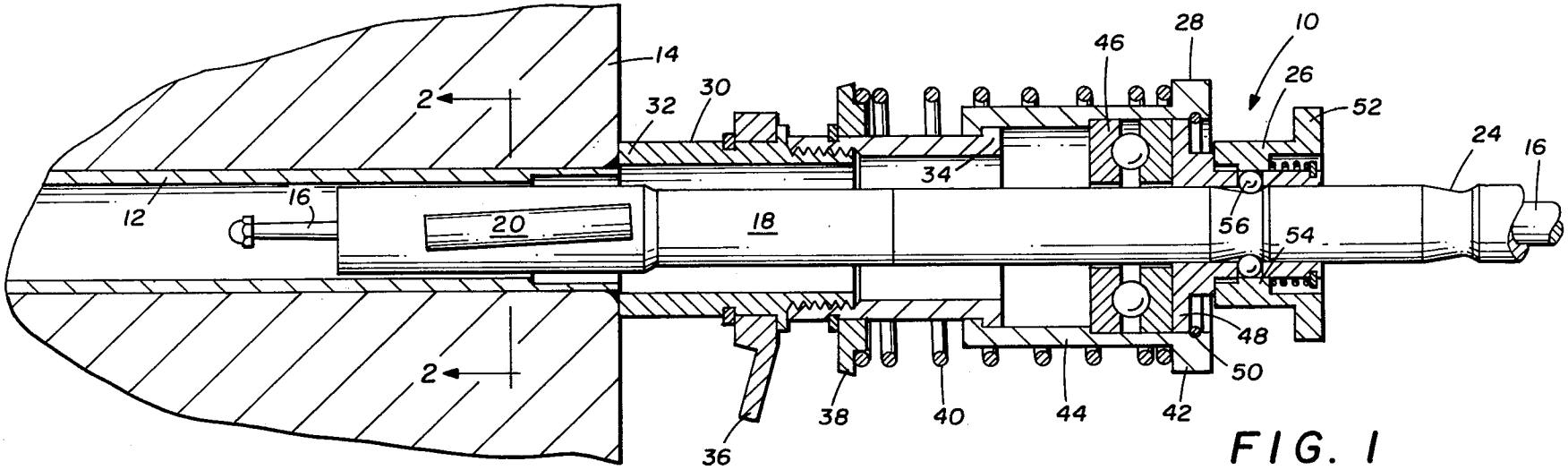
FIG. 1 is a longitudinal, cross-sectional view illustrating an expander constructed in accordance with the invention located in position to expand a tube into a header.

Referring to the drawing and to FIG. 1 in particular, shown therein and generally designated by the reference character 10, is a tubing expander assembly that is inserted into a tube 12 which has been welded to a header 14. It will be understood that only a portion of the expander assembly 10 is illustrated. The portion of the assembly omitted includes apparatus for causing rotation of the expander, indexing the expander and sensing the torque on the expander, which may be as described in previously mentioned U.S. Pat. No. 3,854,314.

Figure 2:
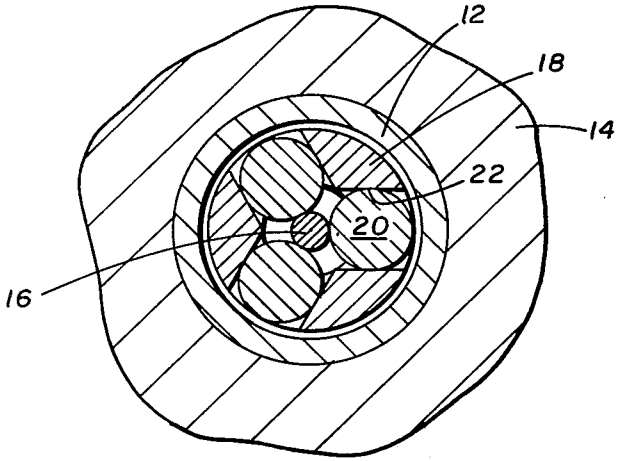
FIG. 2 is an enlarged transverse, cross-sectional view taken along the line 2—2 of FIG. 1.

The expander assembly 10 includes a tapered mandrel 16 that extends entirely through a roller cage 18. The roller cage 18 carries a plurality of rollers 20 in slots 22 that extend through the forward portion of the roller cage 18 as may be seen more clearly in FIG. 2.

The roller cage 18 also includes a plurality of annular grooves 24 that function in cooperation with a ball and cage latch assembly 26 to permit the roller cage 18 to be moved in predetermined increments into the tube 12. The ball and cage assembly 26 forms a position of the thrust collar assembly 28 which is telescopically arranged with respect to a stop collar assembly 30.

The stop collar assembly 30 is illustrated as being constructed of several interconnected parts which may be necessary in order to manufacture the assembly 30, but for operational purposes, they may be considered as a single member. The stop collar assembly 30 includes: a first end 32 that is arranged to engage the face of the header 14; a second end 34 that is arranged to engage a portion of the thrust collar assembly 28 as will be described; a projecting lug 36 which is utilized to actuate the automatic indexing mechanism (not shown); and a radially projecting flange 38 located intermediate the ends 32 and 34, which is provided to engage one end of a compression spring 40. The opposite end of the compression spring 40 engages a radially projecting flange 42 that is located on and forms a part of the thrust collar assembly 28.

The thrust collar assembly 28 includes a sleeve portion 44 that has an interior designed to receive the end 34 of the stop collar assembly 30 and an exterior designed to aid in guiding the compression spring 40. A thrust bearing 46 is located within the sleeve portion 44 and is arranged to engage the end 34 of the stop collar assembly 30 to permit relative rotation between the stop collar assembly 30 and the thrust collar assembly 28, while limiting the relative longitudinal movement therebetween.

The thrust bearing 46 is retained in the sleeve portion 44 by a flat forward surface of a flange portion 48 on the ball and cage latch assembly 26. The ball and latch assembly 26 is retained in the sleeve portion 44 by a lock ring 50 that is carried by the inner periphery of the flange 42 on the thrust collar assembly 28.

The ball and cage latch assembly 26, in addition to the flange portion 48, includes a cage member 52 that has an inwardly extending flange 54 that engages a plurality of balls 56 located in corresponding holes in cage member 52 for engagement with the roller cage 18 in the annular grooves 24. It will be apparent that when the cage member 52 is moved relatively away from the header 14, the inwardly extending flange 54 clears the holes in which the balls 56 are located, permitting the balls 56 to move relatively outwardly a small distance sufficient to clear the larger diameter portion of the roller cage 18. Thus, the roller cage 18 can advanced relative to the thrust collar assembly 28.

OPERATION OF THE PREFERRED EMBODIMENT

When it is desired to expand the tube 12 in the header 14, the expander assembly 10 is placed in the position illustrated in FIG. 1, that is, the expander cage 18 with the rollers 20 therein are located within the tube 12, which is tack-rolled and welded to the header 14. The end 30 of the stop collar assembly is positioned against the face of the header 14.

Figure 3:
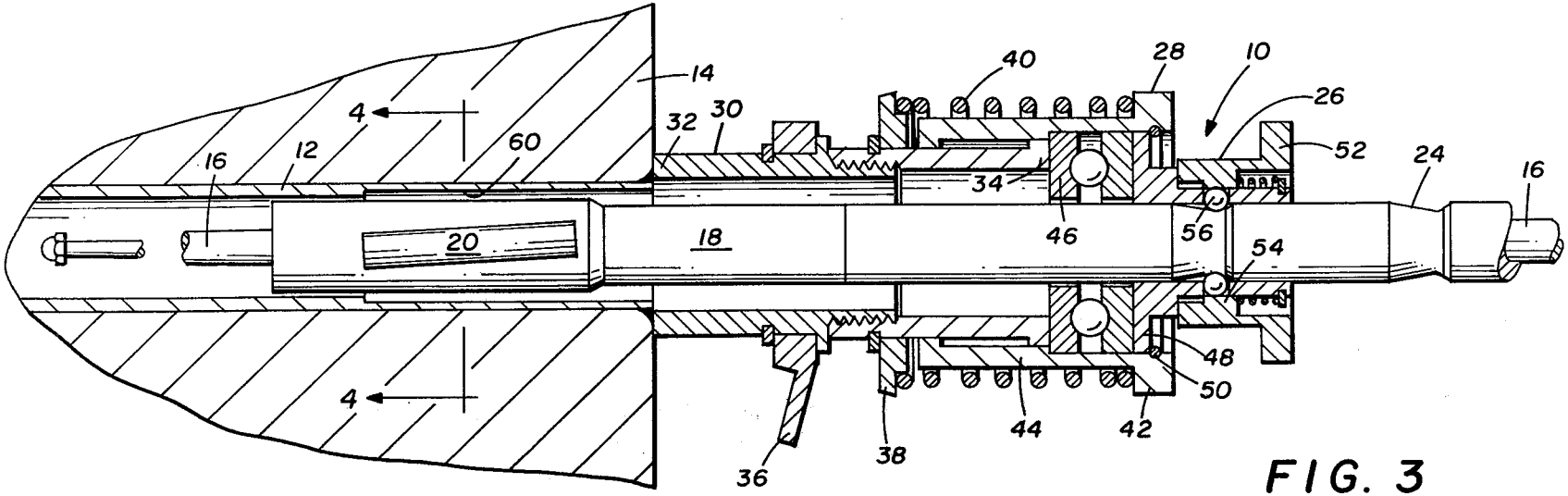
FIG. 3 is a cross-sectional view similar to FIG. 1, but illustrating the expander in another stage of operation.
Figure 4:
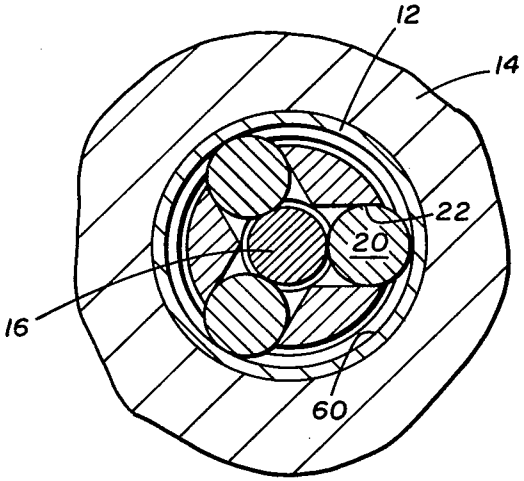
FIG. 4 is an enlarged, transverse, cross-sectional view taken along the line 4—4 of FIG. 3.

At this time, the apparatus (not shown) for causing rotation of the expander assembly 10 is actuated so that the roller cage 18 is caused to rotate and the tapered mandrel 16 is forced relatively inwardly toward the header 14 causing the rollers 20 to expand radially outwardly into engagement with the interior of the tube 12. As the rolling operation progresses, the interior of the tube 12 is enlarged as illustrated by the reference character 60 in FIG. 3. It can also be observed therein that the tapered mandrel 16 has been forced relatively to the left as seen in FIG. 3, until rollers 20 are located to produce the desired reduction in the wall dimension of the tube 12. (See also FIG. 4).

When the first step of the rolling operation is completed, the expander assembly 10 occupies the position illustrated in the FIG. 3, that is, the rollers 20, due to the previously mentioned skewed arrangement, have "screwed" themselves into the tube 12 collapsing the compression spring 40 and telescoping the stop collar assembly 30 relatively into the thrust collar assembly 28 until the end 34 on the stop collar assembly 30 is in engagement with the thrust bearing 46. Thus, it can be appreciated that the expander has been permitted to move simultaneously with the rolling operation relatively into the tube 12 so that thrust forces generated in the tube 12 are toward the left as seen in FIG. 3 and relatively away from the welded end of the tube 12. Also, it can be appreciated that the movement or "drift" is for a predetermined finite distance, that is, the distance determined by the dimension between the end 34 of the stop collar assembly 30 and the face of the thrust bearing 46. Preferably, such dimension will be approximately equal to ½ the length of the rollers 20.

Figure 5:
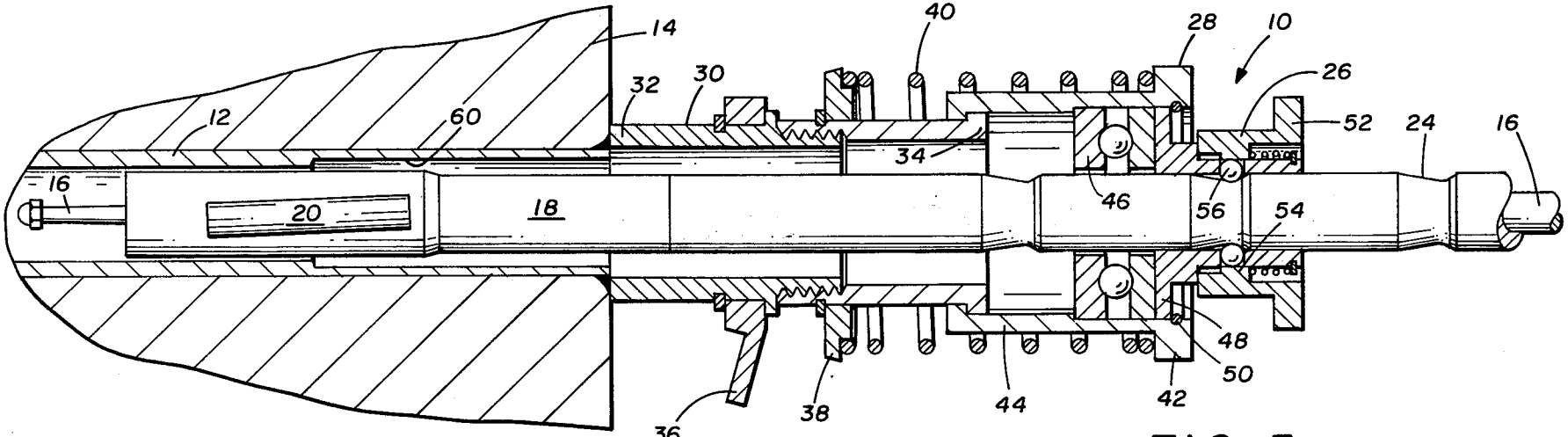
FIG. 5 is a view of the expander in still another operating position.

When the first rolling step has been completed, the expander apparatus 10 will be in the position illustrated in FIG. 3. To position the expander apparatus 10 for the next rolling step, the cage 52 of the ball and cage latch assembly 26 is moved to permit the balls 56 to move out of the annular grooves 24 in the roller cage 18 so that the roller cage 18 can be advanced to the left as seen in FIG. 5, until the balls 56 drop into the next annular groove 24. When the balls 56 drop into the next groove, the cage 52 is released locking the thrust collar assembly 28 to the roller cage 18. Simultaneously, the tapered mandrel 16 is withdrawn permitting the rollers 20 to move inwardly assuming the positions illustrated in FIG. 2.

At the same time, the compression spring 40 expands moving the thrust collar assembly 28 relative to the stop collar assembly 30 into the relative positions illustrated in FIGS. 1 and 5. It will be noted that the annular grooves 24 are spaced in the roller cage 18 so that the end 32 of the stop collar assembly 30 can be positioned against the face of the header 14 and the rollers 20 will be located so that their mid-point longitudinally is approximate opposite to the end of the deformation 60 of the tube 12. At this time, the expander assembly 10 is reactivated as described in connection with the initial rolling step so that the second rolling step commences.

If the header 14 is of relatively large thickness, the foregoing step-wise rolling procedure is repeated until the tube 12 has been rolled into complete engagement therewith. The precise length and spring of the rolling steps is determined by the thickness of the header 14 so that each rolling step is maintained substantially equal.

Carefully controlling the quantity of metal of the tube 12 deformed in each step of the rolling operation results in a substantially smooth bore in the tube 12 after completion of the rolling operation. Also, and as previously mentioned, permitting the rollers 20 to "drift" during rolling away from the face of the header 14 greatly reduces or eliminates stresses if the tube 12 is welded to the header 14.

It will be understood that the embodiment described in detail hereinbefore is presented by way of example only and that many changes and modifications can be made thereto without departing from the spirit of the invention.

I claim:

1. Improved tube expander apparatus comprising:

an elongate, rotatable expander means for insertion into an end of a tube to be expanded against a header;

a stop collar encircling a portion of said expander means, said stop collar having a first end for engaging the header and a second end;

a thrust collar encircling a portion of said expander means and the second end of said stop collar, said stop collar and thrust collar being axially and rotatably movable relative to each other and including cooperable limit means for determining the relative axial movement therebetween; and, connection means for preventing movement between said thrust collar and said expander means, whereby said thrust collar and expander means can move together relative to said stop collar until said thrust collar engages the second end of said stop collar.

2. The improved tube expander of claim 1 and also including resilient means engaging said stop collar and thrust collar for urging said collars relatively apart.

3. The improved tube expander of claim 1 and also including:

an annular flange projecting radially from and mounted on said stop collar intermediate the first and second ends of said stop collar; and a compression spring encircling a portion of said stop collar and thrust collar and having a first end engaging said flange and a second end engaging said thrust collar urging said stop collar and thrust collar relatively apart.

4. The improved tube expander of claim 1 and also including a thrust bearing means located in said thrust collar for engaging the second end of said stop collar arresting axial movement therebetween while permitting relative rotation therebetween.

5. The improved tube expander of claim 4 and also including resilient means engaging said stop collar and thrust collar for urging said collars relatively apart.

6. An improved method for expanding a tube into engagement with a header comprising the steps of:

placing an expander having radially displaceable rollers thereon into said tube a preselected depth;

rotating said expander and displacing said rollers radially outwardly to deform a specified portion of said tube into engagement with said header; and simultaneously permitting said expander to advance into said tube a preselected distance.

7. The improved method of claim 6 and also including the steps of:

retracting said rollers;

advancing said expander into said tube a second preselected distance;

rotating said expander and displacing said rollers radially outwardly to deform a specified portion of said tube into engagement with said header; and simultaneously permitting said expander to advance into said tube said first mentioned preselected distance.

8. The improved method of claim 7 wherein said first mentioned preselected distance is about one-half the length of said rollers.

9. The improved method of claim 8 wherein said second preselected distance is about one-half of the length of said rollers.

* * * * *